US010497306B2

(12) United States Patent
Lee

(10) Patent No.: US 10,497,306 B2
(45) Date of Patent: Dec. 3, 2019

(54) FLEXIBLE DISPLAY APPARATUS AND METHOD OF DRIVING THE SAME

(71) Applicant: Samsung Display Co., Ltd., Yongin-si, Gyeonggi-do (KR)

(72) Inventor: Hyo Jin Lee, Yongin-si (KR)

(73) Assignee: Samsung Display Co., Ltd. (KR)

( * ) Notice: Subject to any disclaimer, the term of this patent is extended or adjusted under 35 U.S.C. 154(b) by 106 days.

(21) Appl. No.: 15/702,516

(22) Filed: Sep. 12, 2017

(65) Prior Publication Data

US 2018/0082632 A1 Mar. 22, 2018

(30) Foreign Application Priority Data

Sep. 20, 2016 (KR) ..... 10-2016-0120213

(51) Int. Cl.
*G09G 3/3225* (2016.01)
*G09G 3/3275* (2016.01)
*G09G 3/3233* (2016.01)

(52) U.S. Cl.
CPC ..... *G09G 3/3225* (2013.01); *G09G 3/3233* (2013.01); *G09G 3/3275* (2013.01); *G09G 2300/0842* (2013.01); *G09G 2300/0866* (2013.01); *G09G 2320/0233* (2013.01); *G09G 2320/0626* (2013.01); *G09G 2380/02* (2013.01)

(58) Field of Classification Search
CPC ... G09G 2300/0842; G09G 2300/0866; G09G 2320/0233; G09G 2320/0626; G09G 2380/02; G09G 3/3225; G09G 3/3233; G09G 3/3275
See application file for complete search history.

(56) References Cited

U.S. PATENT DOCUMENTS 8,963,857 B2 * 2/2015 Kim ..... G06F 3/0487 345/173
2014/0098095 A1 * 4/2014 Lee ..... G06F 3/041 345/420
2014/0306985 A1 * 10/2014 Jeong ..... G09G 3/3233 345/601
2017/0045996 A1 * 2/2017 Ka ..... G06F 3/0483
2017/0206049 A1 * 7/2017 Choi ..... G06F 1/1618
2017/0358252 A1 * 12/2017 Bhageria ..... G09G 3/2003

FOREIGN PATENT DOCUMENTS

KR 10-2014-0124281 10/2014
KR 10-2015-0037485 4/2015
KR 10-1615379 4/2016

* cited by examiner

*Primary Examiner* — Afroza Chowdhury
(74) *Attorney, Agent, or Firm* — Innovation Counsel LLP

(57) ABSTRACT

A flexible display apparatus comprises: a display panel having first and second bending areas bendable at first and second angles along a bending line, first and second display areas extending from the first and second bending areas; a first sensor unit which generates a first sensing signal by measuring the degree of deformation of at least one of the first and second bending areas; a second sensor unit which generates a second sensing signal by measuring the first angle; a third sensor unit which generates a third sensing signal by measuring the second angle; and a controller which receives the first through third sensing signals, determines one of the first and second display areas to be a main viewing area based on the first through third sensing signals, and adjusts a display state of the main viewing area.

17 Claims, 18 Drawing Sheets

FLEXIBLE DISPLAY APPARATUS AND METHOD OF DRIVING THE SAME

This application claims priority to Korean Patent Application No. 10-2016-0120213, filed on Sep. 20, 2016, and all the benefits accruing therefrom under 35 U.S.C. 119, the content of which in its entirety is herein incorporated by reference.

BACKGROUND

1. Field

Exemplary embodiments relate to a flexible display apparatus and a method of driving the same.

2. Description of the Related Art

An organic light-emitting display, which is one of flat panel displays, is an active light-milting display device having a wide viewing angle and excellent contrast and is capable of being driven at a low voltage. In addition, the organic light-emitting display has high response speed. Therefore, the organic light-emitting display is attracting attention as a next-generation display device. A display panel applied to the organic light-emitting display has a flat rectangular shape.

In recent years, flexible display apparatuses that a be bent to become portable and applicable to various devices have been developed.

SUMMARY

Aspects of the inventive concept provide a flexible display apparatus which can determine a main viewing area from among a plurality of display areas and improve the non-uniformity of image quality by adjusting the display state of the main viewing area and a method of driving the flexible display apparatus.

However, aspects of the inventive concept are not restricted to the one set forth herein. The above and other aspects of the inventive concept will become more apparent to one of ordinary skill in the art to which the inventive concept pertains by referencing the detailed description of the inventive concept given below.

In an exemplary embodiment, a flexible display apparatus comprises: a display panel which comprises a first bending area bendable at a first angle along a bending line, a second bending area bendable at a second angle along the bending line, a first display area extending from the first bending area, and a second display area extending from the second bending area; a first sensor unit which is configured to generate a first sensing signal by measuring the degree of deformation of at least one of the first and second bending areas; a second sensor unit which is configured to generate a second sensing signal by measuring the first angle; a third sensor unit which is configured to generate a third sensing signal by measuring the second angle; and a controller which is configured to receive the first, second, and third sensing signals, determine one of the first and second display areas to be a main viewing area based on the first, second, and third sensing signals, and adjust a display state of the main viewing area.

In another exemplary embodiment, a method of driving a flexible display apparatus comprises: determining whether a display panel comprising a plurality of display areas is bent; measuring the degree of bending of the display panel upon a determination that the display panel is bent; determining a main viewing area from among the display areas based on the measured degree of bending; and adjusting a display state of the main viewing area based on the measured degree of bending.

BRIEF DESCRIPTION OF THE DRAWINGS

The above and other features of the inventive concept will become more apparent by describing in detail exemplary embodiments thereof with reference to the attached drawings, in which.

DETAILED DESCRIPTION

Figure 1:
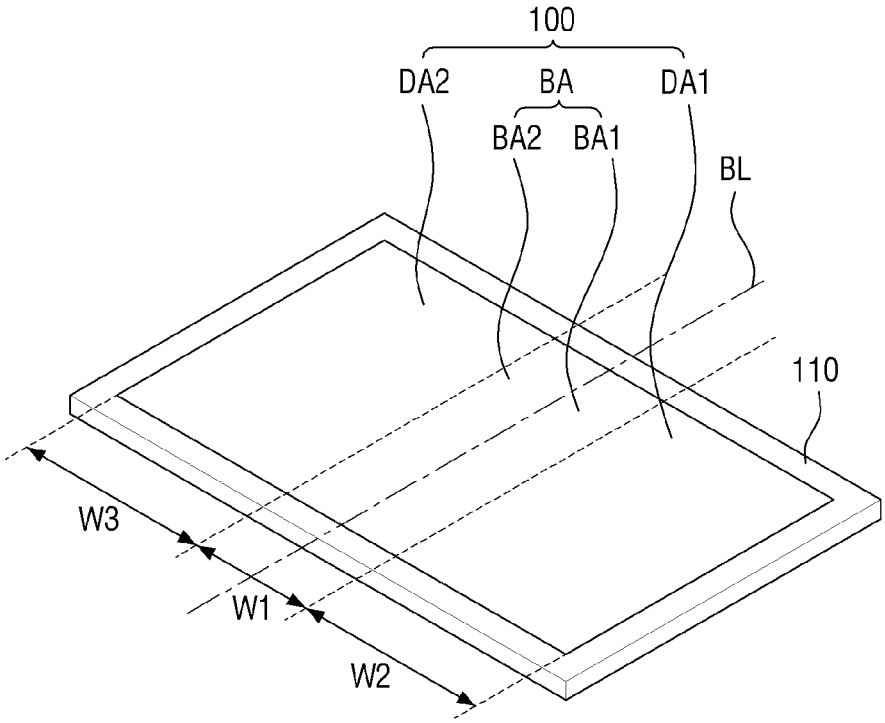
FIG. 1 is a perspective view of a flexible: display apparatus according to an embodiment.

The inventive concept now will be described more fully hereinafter with reference to the accompanying drawings, in which various embodiments are shown. The inventive concept may, however, be embodied in many different forms, and should not be construed as limited to the embodiments set forth herein. Rather, these embodiments are provided so that this disclosure will be thorough and complete, and will fully convey the scope of the inventive concept to those skilled in the art. Like reference numerals refer to like elements throughout.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from X, Y, and Z" may be construed as X only, Y only, Z only, or any combination of two or more of X, Y, and Z, such as, for instance, XYZ, XYY, YZ, and ZZ.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. "Or" means "and/or." As used herein, the term "and/or" includes any and all combinations of one or more of the associated listed items. It will be further understood that the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments will be described in detail with reference to the accompanying drawings.

Figure 2:
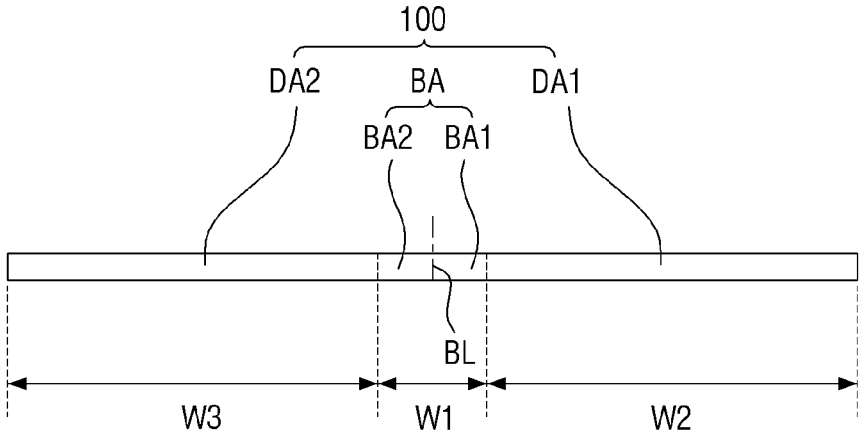
FIG. 2 is a side view of the flexible display apparatus illustrated in FIG. 1.

FIG. 1 is a perspective view of a flexible display apparatus according to an embodiment. FIG. 2 is a side view of the flexible display apparatus illustrated in FIG. 1.

The flexible display apparatus according to the current embodiment may be an organic light-emitting display. However, the flexible display apparatus may also be a liquid crystal display, a field emission display, an electroluminescent display, or an electrophoretic display. Hereinafter, a case where the flexible display apparatus according to the current embodiment is an organic light-emitting display will be described as an example.

Referring to FIGS. 1 and 2, the flexible display apparatus according to the current embodiment may include a display panel 100 and a case unit 110.

The display panel 100 may be an area for displaying an image. The display panel 100 may be shaped like a rectangular plate in an embodiment. However, the shape and size of the display panel 100 are not limited to those illustrated in FIG. 1.

The display panel 100 may include a bending area BA, a first display area DA1, and a second display area DA2.

The bending area BA may include a first bending area BA1 and a second bending area BA2. The first bending area BA1 may be disposed on a side of a bending line BL. The second bending area BA2 may be disposed on the other side opposite to the above side of the bending line BL. At least one of the first bending area BA1 and the second bending area BA2 can be bent at a certain curvature with respect to the bending line BL.

More specifically, in FIGS. 1 and 2, the first bending area BA1 may contact the first display area DA1 and can be bent at a certain curvature. Accordingly, the first display area DA1 can have a certain angle with respect to the second display area DA2. The second bending area BA2 may contact the second display area DA2 and can be bent at a certain curvature. Accordingly, the second display area DA2 can have a certain angle with respect to the first display area DA1. This will be described in more detail later with reference to FIGS. 3 through 5. In addition, in FIGS. 1 and 2, the bending line BL crosses the center of the bending area BA, i.e., the boundary between the first and second bending areas BA1 and BA2. However, the bending line BL does not necessarily cross the center of the bending area BA.

The first and second display areas DA1 and DA2 may each be planar in an embodiment. That is, each of the first and second display areas DA1 and DA2 may not be bent. The first display area DA1 may be symmetrical to the second display area DA2 with respect to the bending area BA. Accordingly, a width w2 of the first display area DA1 may be equal to a width w3 of the second display area DA2. In addition, the widths w2 and w3 of the first and second display areas DA1 and DA2 may be smaller than a width w1 of the bending area BA. However, the width w2 of the first display area DA1 can also be different from the width w3 of the second display area DA2. In addition, the width w2 of the first display area DA1, the width w3 of the second display area DA2, and the width w1 of the bending area BA can also be equal to each other.

The display panel 100 may be mounted on the case unit 110. The material, shape and size of the case unit 110 are not limited as long as the case unit 110 can be bent at a certain curvature.

Figure 3:
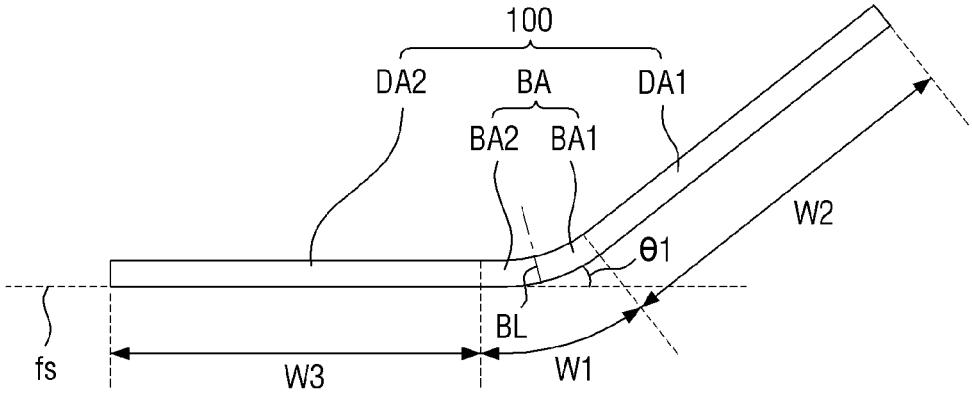
FIG. 3 is a side view illustrating a state in which a first bending region of the flexible display apparatus of FIG. 1 is bent at a certain angle.

FIG. 3 is a side view illustrating a state in which the first bending region BA1 of the flexible display apparatus of FIG. 1 is bent at a certain angle.

Referring to FIG. 3, the first bending area BA1 may be bent at a certain curvature with respect to a bottom surface fs. The curvature of the first bending area BA1 may be expressed as an angle between the first display area DA1 and the bottom surface fs. Accordingly, the first display area DA1 may have a first angle θ1 with respect to the bottom surface fs.

Figure 4:
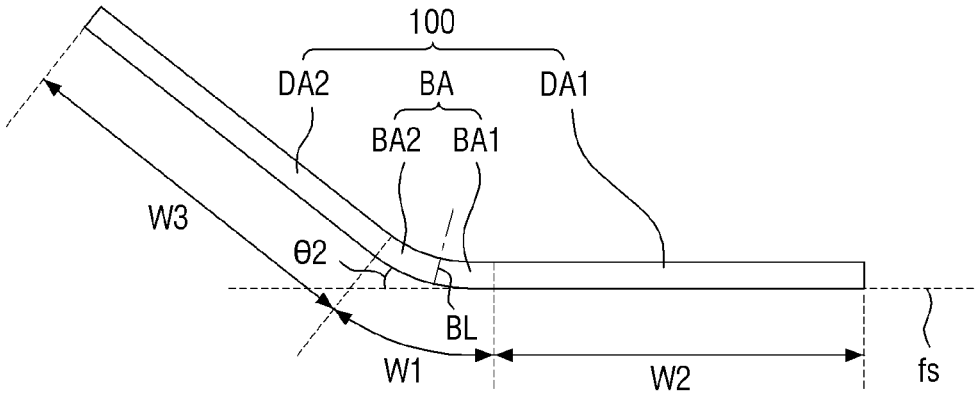
FIG. 4 is a side view illustrating a state in which a second bending area of the flexible display apparatus of FIG. 1 is bent at a certain angle.

FIG. 4 is a side view illustrating a state in which the second bending area BA2 of the flexible display apparatus of FIG. 1 is bent at a certain angle.

Referring to FIG. 4, the second bending area BA2 may be bent at a certain curvature with respect to the bottom surface fs. The curvature of the second bending area BA2 may be expressed as an angle between the second display area DA2 and the bottom surface fs. Accordingly, the second display area DA2 may have a second angle θ2 with respect to the bottom surface fs.

The first angle θ1 may be equal to or different from the second angle θ2. In addition, the first angle θ1 can be defined as an included angle between the bottom surface fs and the first display area DA1, and the second angle θ2 can be defined as an included angle between the bottom surface fs and the second display area DA2. The bottom surface fs is a plane parallel to the bottom surface of the display panel 110 when planar and not bent. Each of the first angle θ1 and the second angle θ2 may be greater than 0 degrees and smaller than 180 degrees in an embodiment.

Figure 5A:
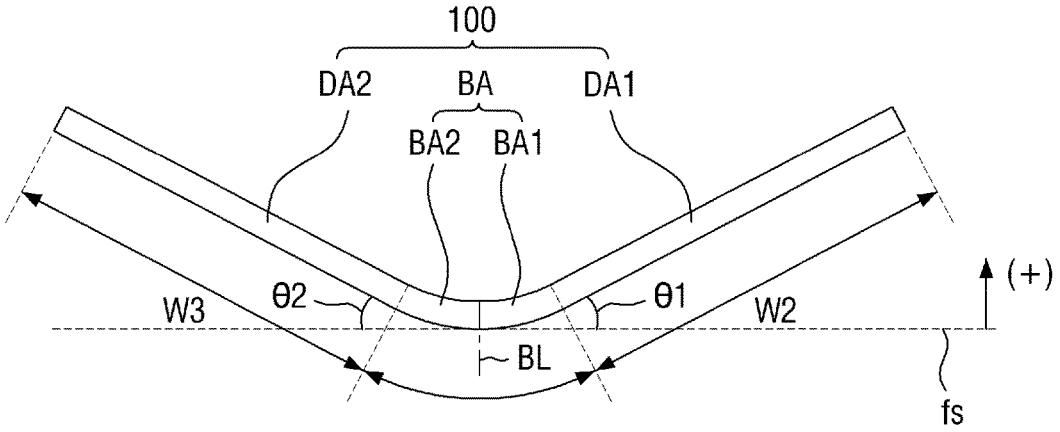
FIGS. 5A and 5B are side views illustrating a state in which each of the first bending area and the second bending area of the flexible display apparatus of FIG. 1 is bent at a certain curvature.
Figure 5B:
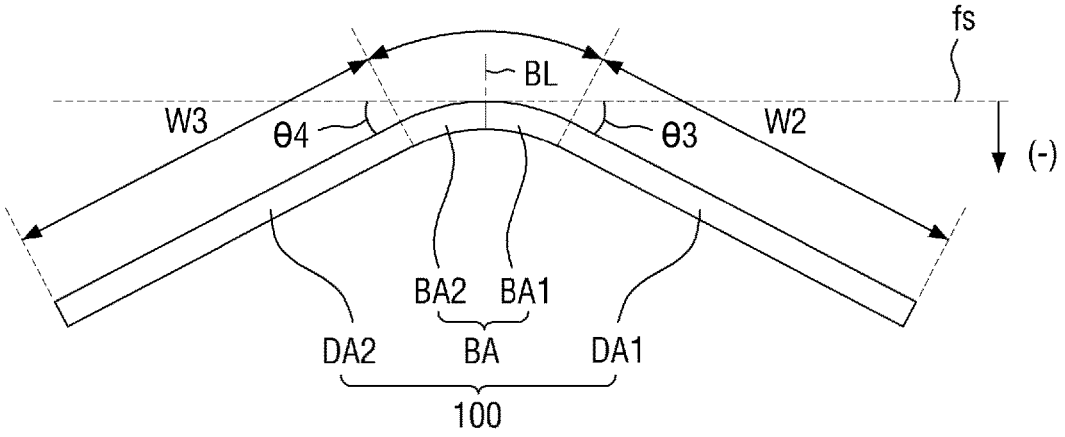

FIGS. 5A and 5B are side views illustrating a state in which each of the first bending area BA1 and the second bending area BA2 of the flexible display apparatus of FIG. 1 is bent at a certain curvature.

Referring to FIG. 5A, both the first bending area BA1 and the second bending area BA2 may be bent at certain curvatures with respect to the bottom surface fs. That is, the first display area DA1 may have the first angle θ1 with respect to the bottom surface fs, and the second display area DA2 may have the second angle θ2 with respect to the bottom surface fs. Here, the curvature of each of the first bending area BA1 and the second bending area BA2 may be expressed by a positive (+) value. That is, respective ends of the first display area DA1 and the second display area DA2 may be oriented in a positive (+) direction from the bottom surface fs. Since the respective ends of the first display area DA1 and the second display area DA2 are oriented in the positive direction from the bottom surface fs, the first angle θ1 and the second angle θ2 may be expressed by positive values.

Referring to FIG. 5B, both the first bending area BA1 and the second bending area BA2 may be bent at certain curvatures with respect to the bottom surface fs. Here, respective ends of the first display area DA1 and the second display area DA2 may be oriented in a negative (−) direction from the bottom surface fs. That is, the first display area DA1 may have a third angle θ3 with respect to the bottom surface fs, and the second display area DA2 may have a fourth angle θ4 with respect to the bottom surface fs. Here, each of the third angle θ3 and the fourth angle θ4 may be greater than 0 degrees and smaller than 180 degrees in an embodiment. In addition, since the respective ends of the first display area DA1 and the second display area DA2 are oriented in the negative direction from the bottom surface fs, the third angle θ3 and the fourth angle θ4 may be expressed by negative values.

The above method of expressing the curvatures of the first bending area BA1 and the second bending area BA2 is merely an example. Thus, various methods can be applied to indicate a state in which the first bending area BA1 and the second bending area BA2 are bent at certain curvatures.

Figure 6:
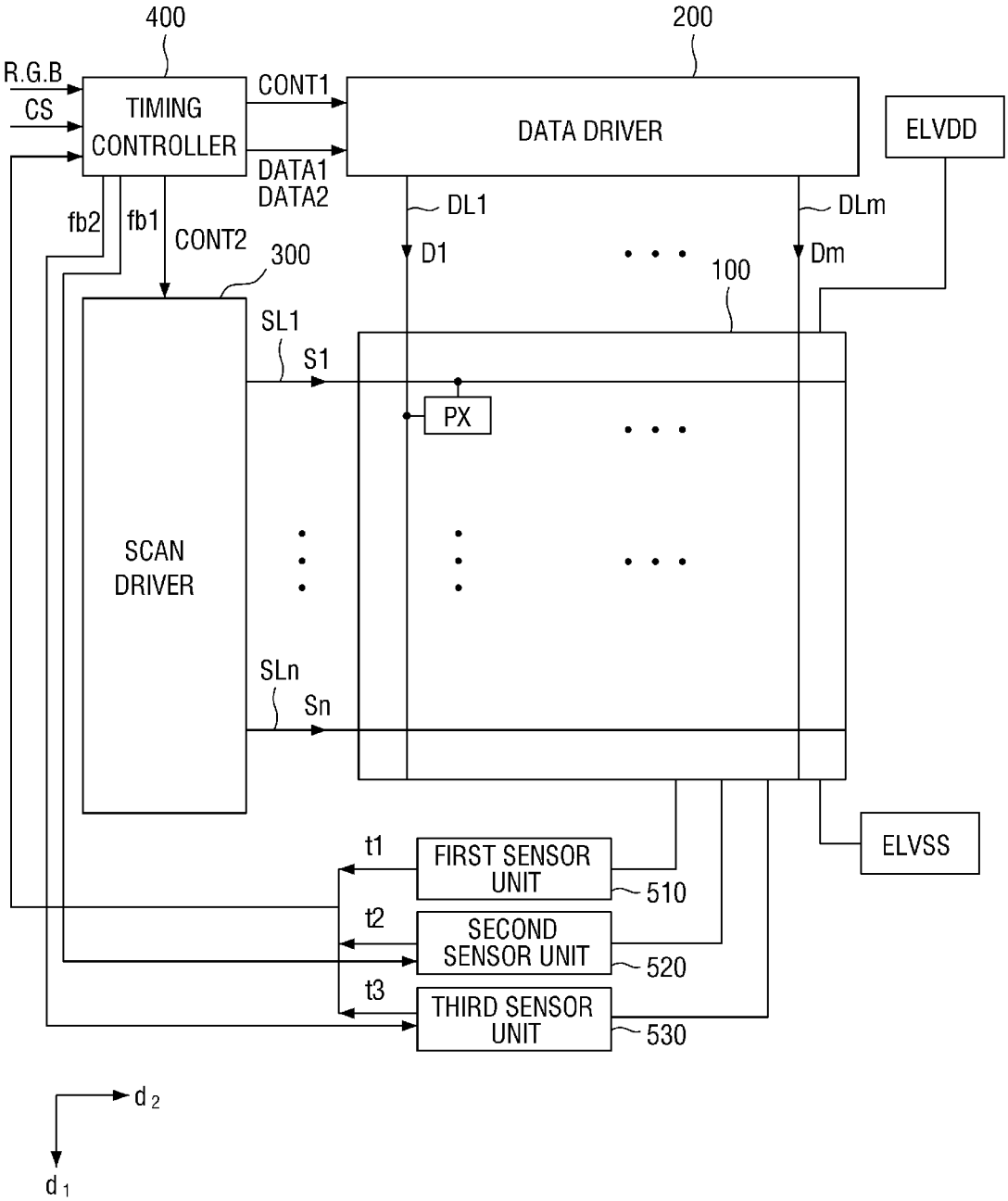
FIG. 6 is a schematic block diagram of the flexible display apparatus illustrated in FIG. 1.

FIG. 6 is a schematic block diagram of the flexible display apparatus illustrated in FIG. 1.

Referring to FIG. 6, the flexible display apparatus according to the current embodiment may include a data driver 200, a scan driver 300, a timing controller 400, a first sensor unit 510, a second sensor unit 520, and a third sensor unit 530. The first sensor unit 510, the second sensor unit 520, and the third sensor unit 530 are also referred to as the first through third sensor units 510 through 530.

The display panel 100 may be connected to the scan driver 300 by first through $n^{th}$ scan lines SL1 through SLn, where n is a natural number of 1 or more. Also, the display panel 100 may be connected to the data driver 200 by first through $m^{th}$ data lines DL1 through DLm, where in is a natural number of 1 or more. The display panel 100 may include a plurality of pixels PX. Each of the pixels PX may be electrically connected to one of the first through the $n^{th}$ scan lines SL1 through SLn and one of the first through $m^{th}$ data lines DL1 through DLm.

The first through $m^{th}$ data lines DL1 through DLm may extend along a first direction d1. In addition, the first through $n^{th}$ scan lines SL1 through SLn may extend along a second direction d2. In an embodiment, the first direction d1 may intersect the second direction d2. In FIG. 6, the first direction d1 is a column direction, and the second direction d2 is a row direction.

The data driver 200 may include a shift register, a latch, and a digital-analog converter (DAC) in an embodiment. The data driver 200 may receive a first control signal CONT1, first image data DATA1, and second image data DATA2 from the timing controller 400. The data driver 200 may select a reference voltage corresponding to the first control signal CONT1 and convert the received first or second image data DATA1 or DATA2 of a digital waveform into first through mth data signals D1 through Dm according to the selected reference voltage. The data driver 200 may provide the generated first through $m^{th}$ data signals D1 through Dm to the display panel 100.

The scan driver 300 may receive a second control signal CONT2 from the timing controller 400. The scan driver 300 may provide a plurality of scan signals S1 through Sn to the display panel 100 according to the received second control signal CONT2.

The timing controller 400 may receive an image signal R.G.B and a control signal CS from an external source. The control signal CS may include a vertical synchronization signal Vsync, a horizontal synchronization signal, a main clock signal, and a data enable signal in an embodiment. The timing controller 400 may process the signals received from the external source according to operation conditions of the display panel 100 and then generate the first image data DATA1, the first control signal CONT1 and the second control signal CONT2.

In addition, the timing controller 400 may receive a first sensing signal t1, a second sensing signal t2, and a third sensing signal t3 from the first through third sensor units 510 through 530, respectively. The first sensing signal t1, the second sensing signal t2, and the third sensing signal t3 are also referred to as the first through third sensing signals t1 through t3. The timing controller 400 may generate the second image data DATA2 by correcting the first image data DATA1 based on the first through third sensing signals t1 through t3. This will be described later.

The first control signal CONT1 may include a horizontal synchronization signal for instructing the start of the input of the first image data DATA1 or the second image data DATA2 and a load signal for controlling the transmission of the first through $m^{th}$ data signals D1 through Dm to the first through $m^{th}$ data lines DL1 through DLm. The second control signal CONT2 may include a scan start signal for instructing the start of the output of first through $n^{th}$ gate signals S1 through Sn and a gate clock signal for controlling the output timing of a scan-on pulse.

The display panel 100 may receive a first driving voltage ELVDD and a second driving voltage ELVSS from a power supply unit (not illustrated). This will be described later with reference to FIG. 7.

The first sensor unit 510 may determine whether the display panel 100 is bent, generate the first sensing signal t1 based on the determination result, and provide the first sensing signal t1 to the timing controller 400. The second sensor unit 520 and the third sensor unit 530 may measure the degree to which the display panel 100 is bent, generate the second and third sensing signals t2 and t3 based on the measured degree of bending, and provide the second and third sensing signals t2 and t3 to the tinting controller 400, respectively. The first through third sensor units 510 through 530 will be described later with reference to FIGS. 8 through 10.

Figure 7:
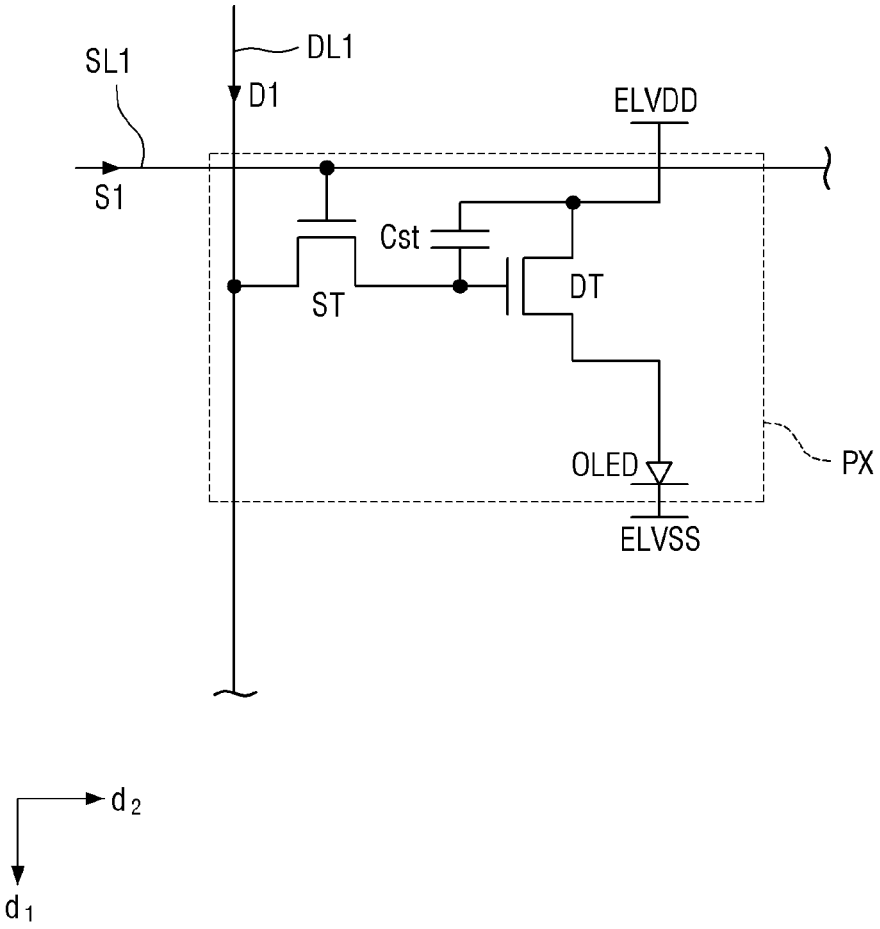
FIG. 7 is an equivalent circuit diagram of an embodiment of a pixel illustrated in FIG. 6.

FIG. 7 is an equivalent circuit diagram of an embodiment of a pixel PX illustrated in FIG. 6. In FIG. 7, a pixel PX electrically connected to the first scan line SL1 and the first data line DL1 will be described.

Referring to FIG. 7, the pixel PX may include a first switching device ST, a second switching device DT, an organic light-emitting diode OLED, and a storage capacitor Cst.

The first switching device ST may be electrically connected to the first scan line. SL1, the first data line DL1, and the second switching device DT. In an embodiment, each of the first switching device ST and the second switching device DT may be a three-terminal device such as a thin-film transistor. Hereinafter, a case where the first switching device ST and the second switching device DT are thin-film transistors will be described as an example.

The first switching device ST may include a control electrode electrically connected to the first scan line SL1, a first electrode electrically connected to the first data line DL1, and a second electrode electrically connected to a control electrode of the second switching device DT.

The second switching device DT may include the control electrode electrically connected to the second electrode of the first switching device ST, a first electrode electrically connected to a driving voltage line to which the first driving voltage ELVDD is provided, and a second electrode electrically connected to the organic light-emitting diode OLED.

The storage capacitor Cst may include a first electrode electrically connected to the second electrode of the first switching device ST and a second electrode electrically connected to the driving voltage line to which the first driving voltage ELVDD is provided.

The first switching device ST may be turned on by a signal received from the first scan line SL1 to provide a data signal received from the first data line DL1 to the storage capacitor Cst. The storage capacitor Cst may be charged with a difference between the voltage of the data signal and the first driving voltage ELVDD. The second switching device DT may control the amount of driving current supplied from the driving voltage line according to the voltage charged in the storage capacitor Cst.

That is, the first switching device ST may be a switching transistor, and the second switching device DT may be a driving transistor.

The operation of the flexible display apparatus according to the current embodiment will now be described with reference to FIGS. 6, 8, and 9.

Figure 8:
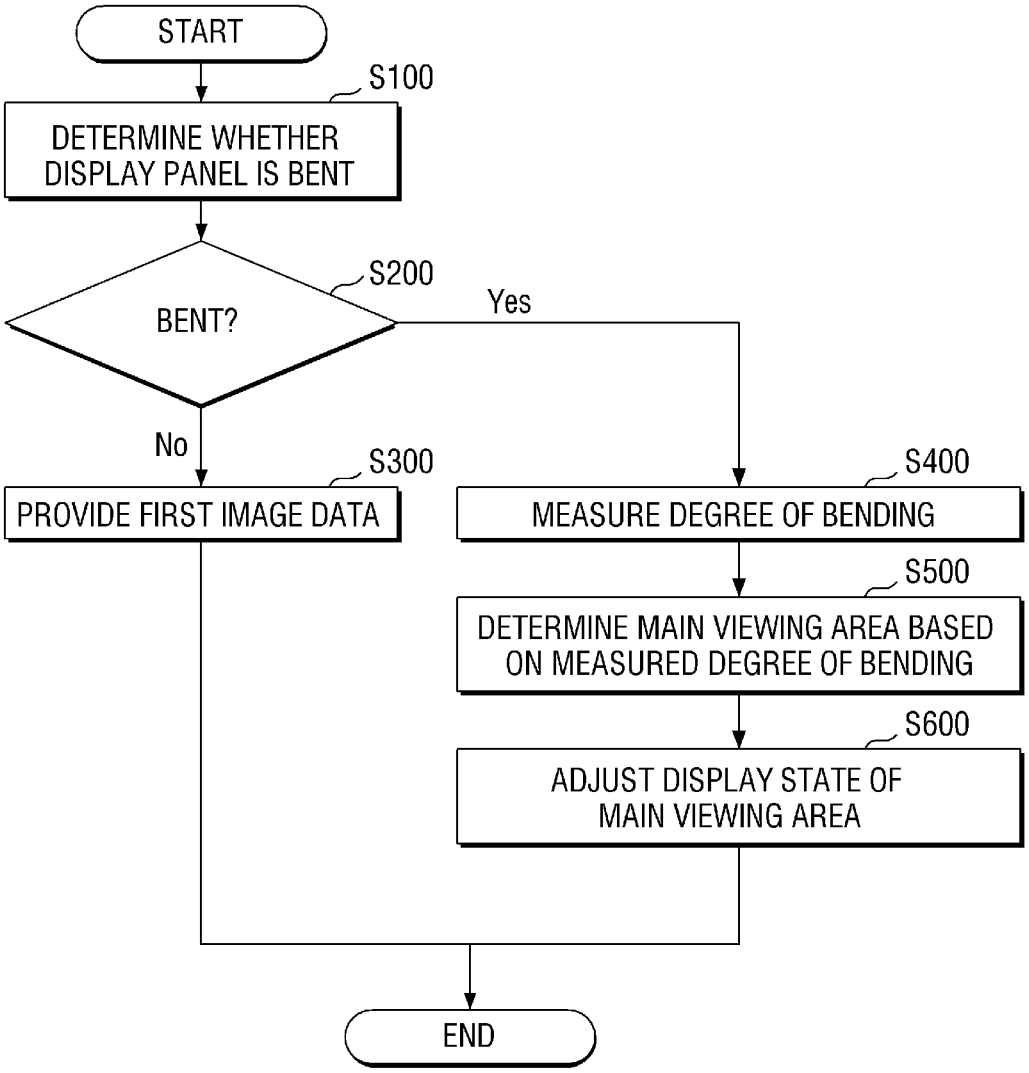
FIGS. 8 and 9 are flowcharts illustrating a method of driving a flexible display apparatus according to an embodiment.
Figure 9:
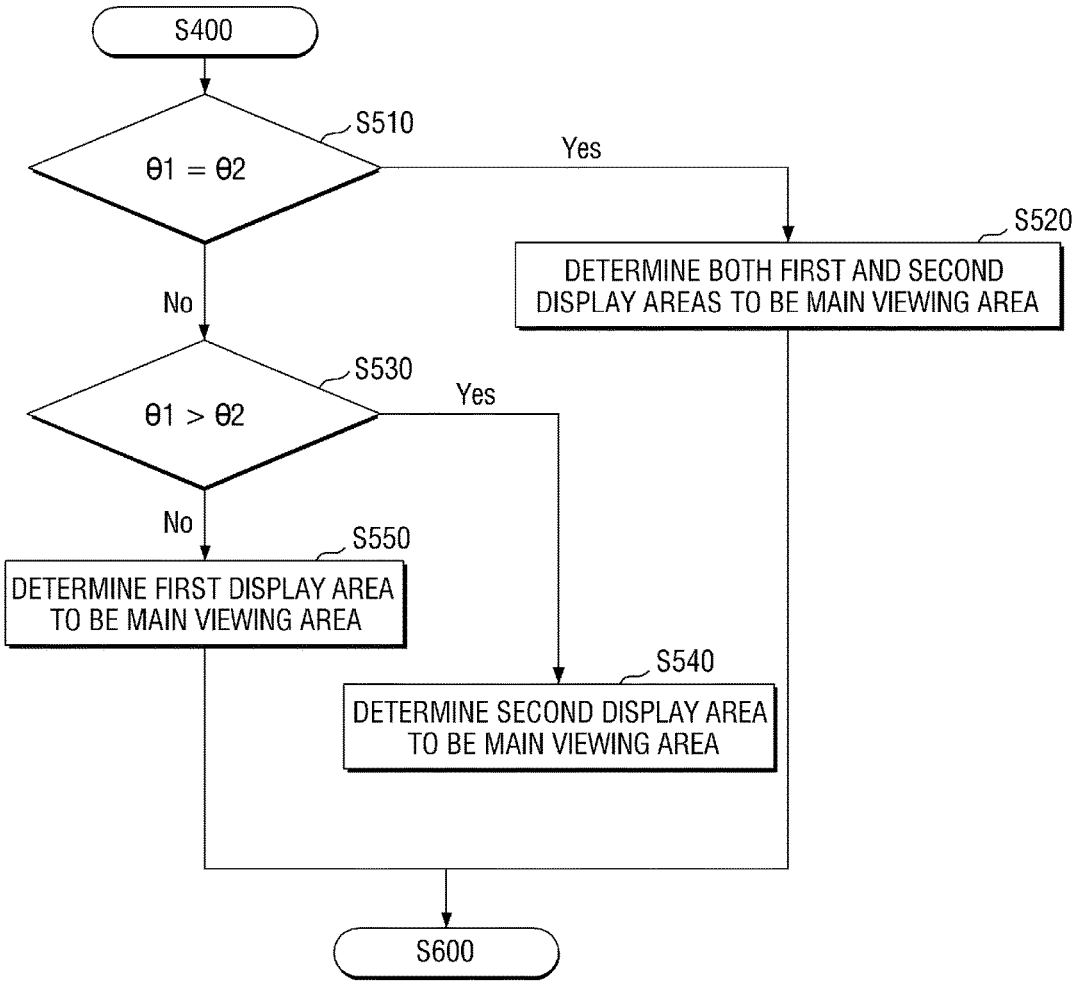
Figure 10:
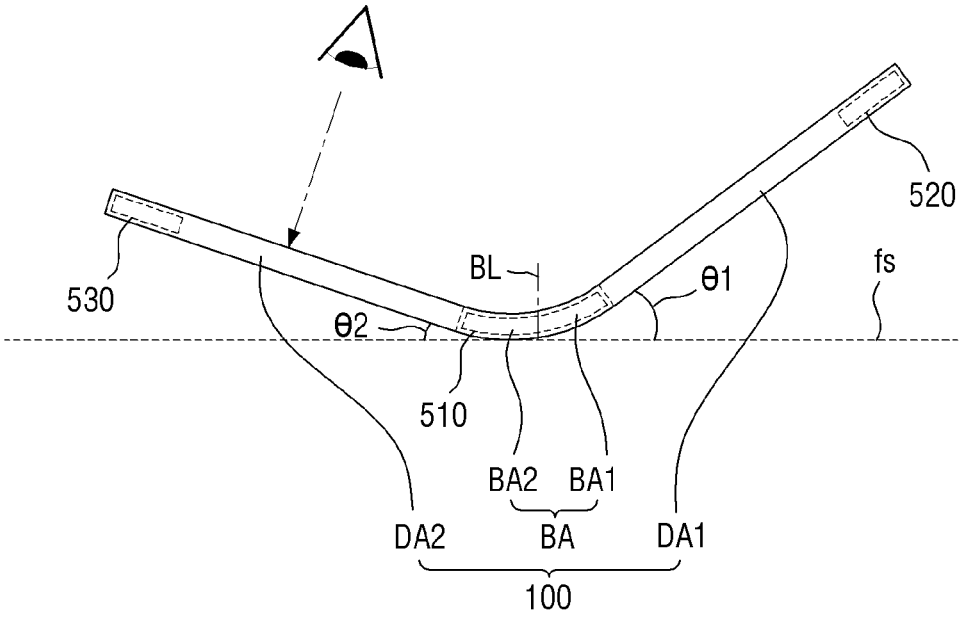
FIG. 10 is a diagram for explaining the method of driving a flexible display apparatus according to the embodiment of FIGS. 8 and 9.
Figure 11:
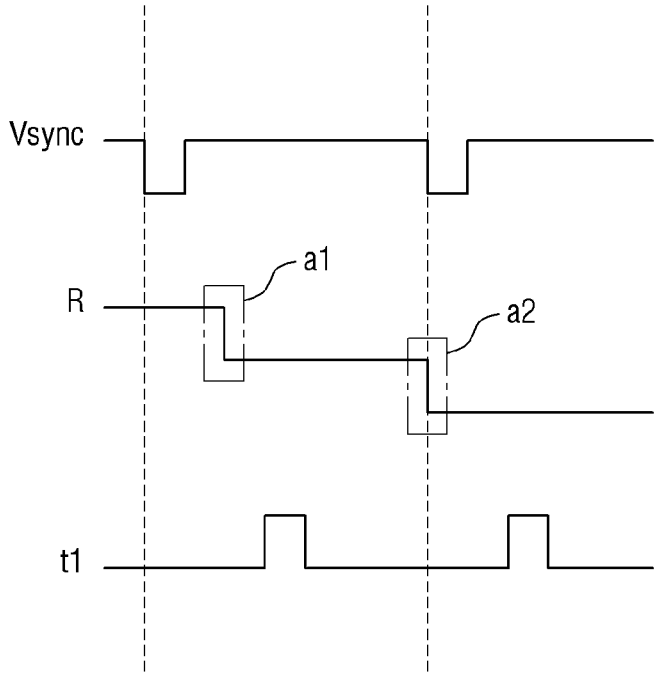
FIG. 11 is a diagram for explaining a method of determining whether a flexible display apparatus is bent in the method of driving a flexible display apparatus according to the embodiment of FIGS. 8 and 9.

FIGS. 8 and 9 are flowcharts illustrating a method of driving a flexible display apparatus according to an embodiment. FIG. 10 is a diagram for explaining the method of driving a flexible display apparatus according to the embodiment. FIG. 11 is a diagram for explaining a method of determining whether a flexible display apparatus is bent in the method of driving a flexible display apparatus according to the embodiment.

Referring to FIGS. 6 8, 9, and 10, the first sensor unit 510 may measure the degree of deformation of the display panel 100. That is, the first sensor unit 510 may determine whether the display panel 100 is bent by using the degree of deformation of the display panel 100 (operation S100). The first sensor unit 510 may be located in the bending area BA in an embodiment. However, the position of the first sensor unit 510 is not limited to the position illustrated in FIG. 10, and the position, size, number, and shape of the first sensor unit 510 are not particularly limited as long as the first sensor unit 510 can determine whether the display panel 100 is bent.

In an embodiment, the first sensor unit 510 may determine whether the display panel 100 is bent by using the degree of resistance change. That is, the first sensor unit 510 may be a strain sensor. In this case, the first sensor unit 510 may include a strain gage and a resistance value measuring unit. The strain gauge may be attached to the bending area BA. The resistance value measuring unit may measure a change in a resistance value of the strain gauge attached to the bending area BA. In an embodiment, the resistance value of the strain gauge may change when the bending area BA is bent at a certain curvature.

Referring to FIG. 11, in an embodiment, the first sensor unit 510 may measure the resistance value R of the strain gauge based on a period of the vertical synchronization signal Vsync. To this end, the first sensor unit 510 may receive the vertical synchronization signal Vsync from the timing controller 400 or an external source. For example, the first sensor unit 510 may judge a change in the resistance value R of the strain gauge according to the vertical synchronization signal Vsync. When the resistance value R of the strain gauge is changed as in areas a1 and a2 of FIG. 11, the first sensor unit 510 may generate the first sensing signal t1 and provide the first sensing signal t1 to the timing controller 400.

That is, the first sensing signal t1 may include a measured change in the resistance value R of the strain gage. The first sensor unit 510 may be located in each of the first and second bending areas BA1 and BA2 or may be located in one of the first and second bending areas BA1 and BA2.

In an embodiment, the first sensor unit 510 may be a hall sensor. In this case, the first sensor unit 510 may generate the first sensing signal a by forming a magnetic field in the bending area BA through which a certain current flows and measuring a voltage generated in a direction perpendicular to the current and the magnetic field.

The timing controller 400 may receive the first sensing signal t1 and determine whether the display panel 100 is bent based on the first sensing signal t1 (operation S200). More specifically, the timing controller 400 converts a change in the resistance value of the strain gauge included in the first sensing signal t1 into a value, compares the value with a preset value, and determines that the display panel 100 is bent when the value is equal to or greater than a preset value.

For example, when a measured change in the resistance value of the strain gauge is zero, the timing controller 400 determines that the display panel 100 is not bent. In this case, the timing controller 400 may provide the first image data DATA1 to the data driver 200 (operation S300). Here, the first image data DATA1 is defined as data generated based on the image signal R.G.B received from an external source.

On the other hand, when the measured change in the resistance value of the strain gauge exceeds the preset value, the timing controller 400 determines that the display panel 100 is bent. In this case, the timing controller 400 may control the second sensor unit 520 and the third sensor unit 530 to measure the degree to which the display panel 100 is bent by providing first and second start signals fb1 and fb2 to the second sensor unit 520 and the third sensor unit 530, respectively.

The second sensor unit 520 and the third sensor unit 530 measure the degree of bending of the display panel 100 in response to the first and second start signals fb1 and fb2 (operation S400). The second sensor unit 520 may measure the first angle θ1 between the first display area DA1 and the bottom surface fs. The second sensor unit 520 may be located in the first display area DA1 in an embodiment. However, the position of the second sensor unit 520 is not limited to the position illustrated in FIG. 10, and the position, size, number and shape of the second sensor unit 520 are not particularly limited as long as the second sensor unit 520 can measure the first angle θ1 between the first display area DA1 and the bottom surface fs. The second sensor unit 520 may generate the second sensing signal t2 based on the measured first angle θ1. The second sensor unit 520 may provide the generated second sensing signal t2 to the timing controller 400. Accordingly, the second sensing signal t2 may include the value of the first angle θ1.

The third sensor unit 530 may measure the second angle θ2 between the second display area DA2 and the bottom surface fs. The third sensor unit 530 may be located in the second display area DA2 in an embodiment. However, the position of the third sensor unit 530 is not limited to the position illustrated in FIG. 10, and the position, size, number and shape of the third sensor unit 530 are not particularly limited as long as the third sensor unit 530 can measure the second angle θ2 between the second display area DA2 and the bottom surface fs. The third sensor unit 530 may generate the third sensing signal t3 based on the measured second angle θ2. The third sensor unit 530 may provide the generated third sensing signal t3 to the timing controller 400. Accordingly, the third sensing signal t3 may include the value of the second angle θ2.

In an embodiment, the second sensor unit 520 and the third sensor unit 530 may be gyro sensors.

The timing controller 400 may determine a main viewing area of the display panel 100 using the second and third sensing signals t2 and t3 received from the second and third sensor units 520 and 530, respectively (operation S500).

This will be described in more detail with reference to FIG. 9.

Referring to FIG. 9, the timing controller 400 may determine whether the value of the first angle θ1 included in the second sensing signal t2 is equal to the value of the second angle θ2 included in the third sensing signal t3 (operation S510). When the value of the first angle θ1 and the value of the second angle θ2 are equal, the timing controller 400 determines both the first and second display areas DA1 and DA2 to be the main viewing area (operation S520). Here, the main viewing area refers to an area determined to be mainly viewed among the first and second display areas DA1 and DA2. When both the first and second display areas DA1 and DA2 are determined to be the main viewing area, the timing controller 400 may adjust display states of the first and second display areas DA1 and DA2 in order to reduce a luminance difference between the two display areas DA1 and DA2.

On the other hand, when the value of the first angle θ1 is different from the value of the second angle θ2, the timing controller 400 may compare the value of the first angle θ1 and the value of the second angle θ2 (operation S530).

For example, when the value of the first angle θ1 is larger than the value of the second angle θ2, the timing controller 400 determines the second display area DA2 to be the main viewing area (operation S540). When the first angle θ1 is larger than the value of the second angle θ2, an absolute value of a slope between the first display area DA1 and the bottom surface fs is larger than an absolute value of a slope between the second display area DA2 and the bottom surfaces fs.

On the other hand, when the value of the first angle θ1 is smaller than the value of the second angle θ2, the timing controller 400 determines the first display area DA1 to be the main viewing area (operation S550). When the value of the first angle θ1 is smaller than the value of the second angle θ2, the absolute value of the slope between the first display area DA1 and the bottom surface fs is smaller than the absolute value of the slope between the second display area DA2 and the bottom surface fs.

A case where the second display area DA2 is determined to be the main viewing area will now be described as an example with reference to FIG. 10.

When the value of the first angle θ1 is larger than the value of the second angle θ2, that is, when the absolute value of the slope between the first display area DA1 and the bottom surface fs is larger than the absolute value of the slope between the second display area DA2 and the bottom surface fs, the timing controller 400 may determine the second display area DA2 to be the main viewing area.

Then, the timing controller 400 may adjust the display state of the second display area DA2 determined to be the main viewing area (operation S600). Here, the display state refers to the state of an image to be displayed in the second display area DA2. In addition, adjusting the display state may include adjusting the luminance, color and brightness of an image to be displayed. The slopes of the first and second display areas DA1 and DA2 may determine a viewing angle. Thus, the flexible display apparatus according to the embodiment can enhance a user's feeling of immersion by adjusting the display state according to the slopes of the first and second display areas DA1 and DA2.

More specifically, the timing controller 400 may generate correction data for adjusting the display state based on at least one of the second sensing signal t2 received from the second sensor unit 520 and the third sensing signal t3 received from the third sensor unit 530. The timing controller 400 may generate the second image data DATA2 by correcting the first image data DATA1 based on the generated correction data. The timing controller 400 may provide the generated second image data DATA2 to the data driver 200.

The data driver 200 may receive the second image data DATA2, convert the second image data DATA2 into the first through $m^{th}$ data signals D1 through Dm, and provide the first through $m^{th}$ data signals D1 through Dm to the display panel 100. In an embodiment, the second image data DATA2 may be provided only to data lines which provide data signals to the second display area DA2 or to all of the first through $m^{th}$ data lines DL1 through DLm.

For example, the luminance of the second display area DA2 may be increased compared with that of the first display area DA1, or the color of the second display area DA2 may be corrected. In addition, since the first display area DA1 serves as an auxiliary viewing area, the luminance of the first display area DA1 may be reduced. Alternatively, the first display area DA1 may display black, thereby reducing power consumption.

In an embodiment, the timing controller 400 may include a lookup table (LUT) that stores in advance the relationship between the values of the first and second angles θ1 and 02 and data signals.

While a case where the first through third sensor units 510 through 530 provide the first through third sensing signals a through t3 to the timing controller 400 and where the timing controller 400 determines the main viewing area and adjusts the display state has been described above as an example, the inventive concept is not limited to this case. That is, a flexible display apparatus according to an embodiment may further include a control unit separate from the timing controller 400, and the control unit may perform the above operation.

Figure 12:
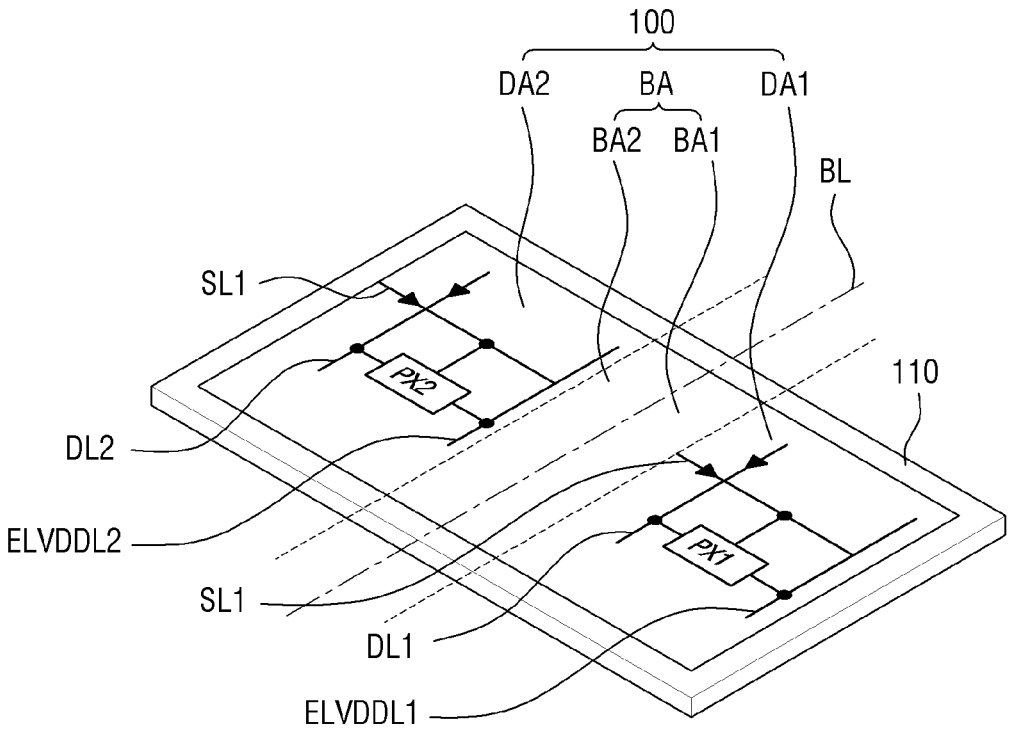
FIG. 12 is a schematic perspective view of a flexible display apparatus according to an embodiment.
Figure 13:
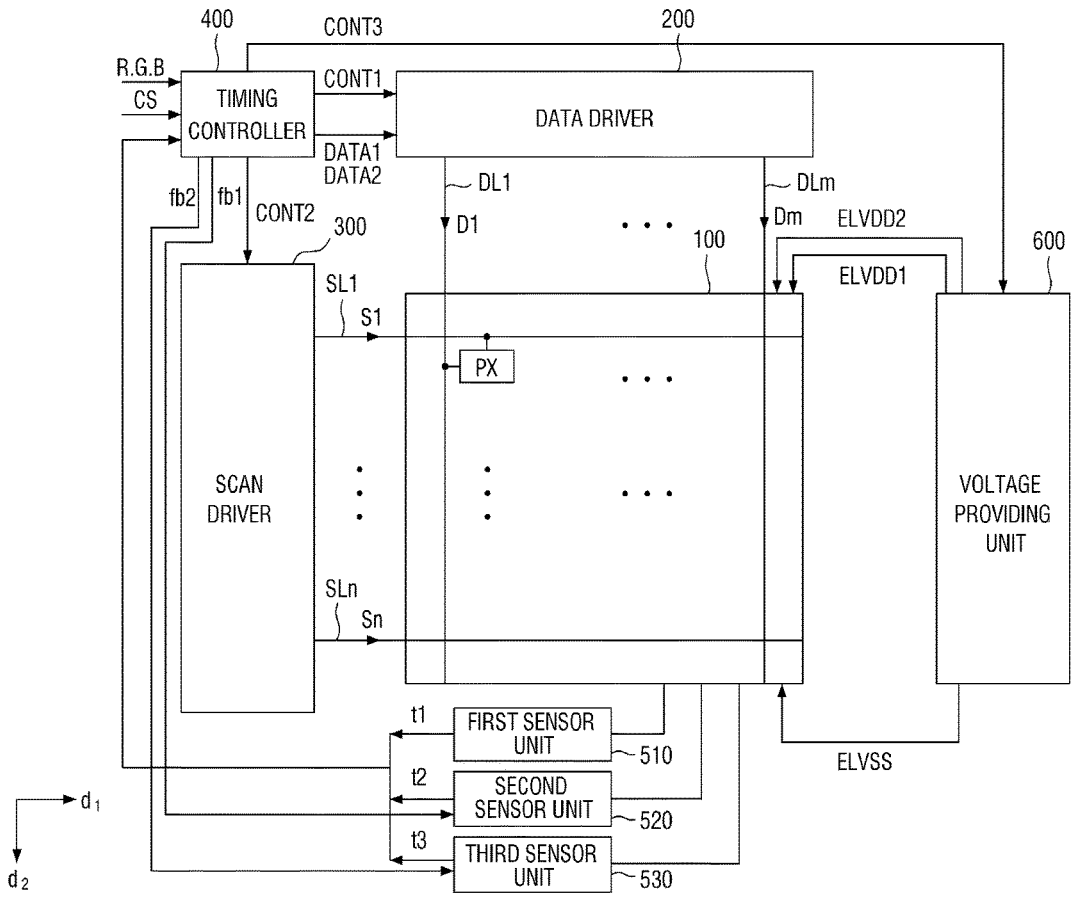
FIG. 13 is a schematic block diagram of the flexible display apparatus illustrated in FIG. 12.
Figure 14A:
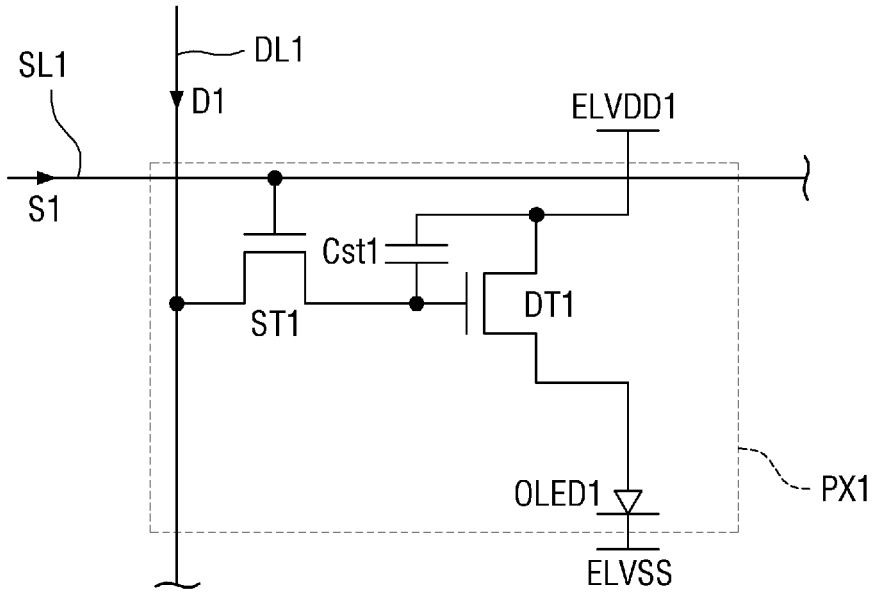
FIGS. 14A and 14B are equivalent circuit diagrams of an embodiment of a first pixel and a second pixel illustrated in FIG. 13, respectively.
Figure 14B:
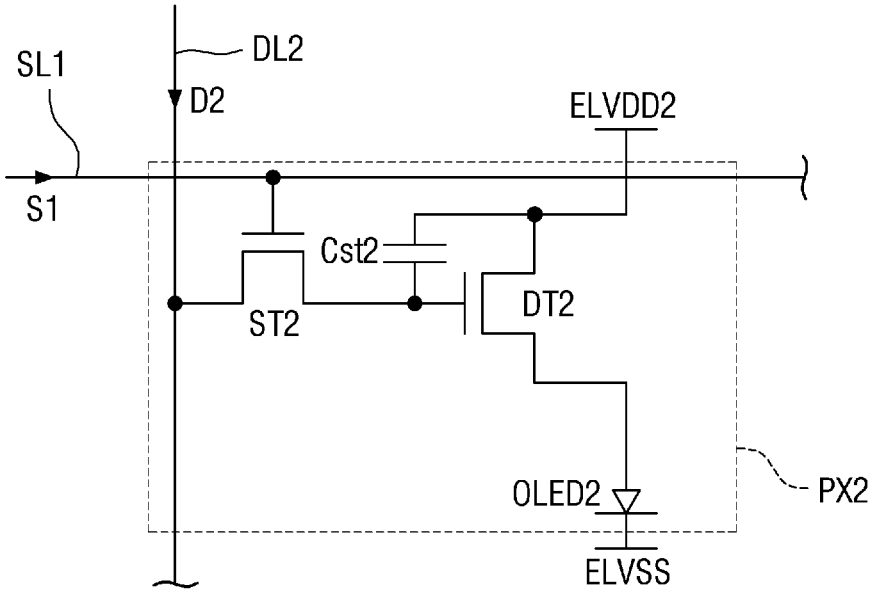

FIG. 12 is a schematic perspective view of a flexible display apparatus according to an embodiment. FIG. 13 is a schematic block diagram of the flexible display apparatus illustrated in FIG. 12. FIGS. 14A and 14B are equivalent circuit diagrams of an embodiment of a first pixel and a second pixel illustrated in FIG. 13, respectively.

For simplicity, a description of elements and features identical to those described above with reference to FIGS. 1 through 11 will be omitted.

Referring to FIGS. 12 through 14, a plurality of pixels including a first pixel PX1 may be disposed in a first display area DA1. A plurality of pixels including a second pixel PX2 may be disposed in a second display area DA2. In an embodiment, the first pixel PX1 and the second pixel PX2 may be connected to the same scan line. In addition, in an embodiment, the first pixel PX1 and the second pixel PX2 may be connected to different data lines. Hereinafter, a case where the first pixel PX1 and the second pixel PX2 are connected to the same scan line and to different data lines will be described as an example.

The flexible display apparatus according to the current embodiment may further include a voltage providing unit 600 which provides a first sub-driving voltage ELVDD1 to the first pixel PX1 and a second sub-driving voltage ELVDD2 to the second pixel PX2. In addition, the voltage providing unit 600 may provide a second driving voltage ELVSS to the first and second pixels PX1 and PX2. Here, the level of the first sub-driving voltage ELVDD1 may be equal to or different from that of the second sub-driving voltage ELVDD2.

The first pixel PX1 may include a first scan transistor ST1, a first driving transistor DT1, a first organic light-emitting diode OLED1, and a first storage capacitor Cst1.

The first scan transistor ST1 may be electrically connected to a first scan line SL1, a first data line DL1, and the first driving transistor DT1. The first driving transistor DT1 may be electrically connected to the first scan transistor ST1, a first driving voltage line to which the first sub-driving voltage ELVDD1 is provided, and the first organic light-emitting diode OLED1.

The first storage capacitor Cst1 may include a first electrode electrically connected to the first scan transistor ST1 and a second electrode electrically connected to the first driving voltage line to which the first sub-driving voltage ELVDD1 is provided.

The first scan transistor ST1 may be turned on by a signal received from the first scan line SL1 to provide a data signal received from the first data line DL1 to the first storage capacitor Cst1. The first storage capacitor Cst1 may be charged with a difference between the voltage of the received data signal and the first sub-driving voltage ELVDD1.

The second pixel PX2 may have a second scan transistor ST2, a second driving transistor DT2, a second organic light-emitting diode OLED2, and a second storage capacitor Cst2.

The second scan transistor ST2 may be electrically connected to the first scan line SL1, a second data line DL2, and the second driving transistor DT2. The second driving transistor DT2 may be electrically connected to the second scan transistor ST2, a second driving voltage line to which the second sub-driving voltage ELVDD2 is provided, and the second organic light-emitting diode OLED2.

The second storage capacitor Cst2 may have a first electrode electrically connected to the second scan transistor ST2 and a second electrode electrically connected to the second driving voltage line to which the second sub-driving voltage ELVDD2 is provided.

The second scan transistor ST2 may be turned on by a signal received from the first scan line SL1 to provide a data signal received from the second data line DL2 to the second storage capacitor Cst2. The second storage capacitor Cst2 may be charged with a difference between the voltage of the received data signal and the second sub-driving voltage ELVDD2.

A timing controller 400 may determine whether a display panel 100 is bent based on a first sensing signal a received from a first sensor unit 510. When determining that the display panel 100 is bent, the timing controller 400 may control a second sensor unit 520 and a third sensor unit 530 to measure the degree to which the display panel 100 is bent by providing first and second start signals fb1 and fb2 to the second sensor unit 520 and the third sensor unit 530, respectively.

The second sensor unit 520 and the third sensor unit 530 may measure the degree of bending of the display panel 100 in response to the first and second start signals fb1 and fb2 and provide the measurement results to the timing controller 400 as a second sensing signal t2 and a third sensing signal t3, respectively.

The timing controller 400 may determine a main viewing area of the display panel 100 using the second and third sensing signals t2 and t3 received from the second and third sensor units 520 and 530. When determining the second display area DA2 to be the main viewing area, the timing controller 400 may generate correction data for adjusting the display state of the second display area DA2.

The timing controller 400 may generate a third control signal CONT3 based on the generated correction data and provide the third control signal CONT3 to the voltage providing unit 600. The voltage providing unit 600 may receive the third control signal CONT3 and adjust the level of the second sub-driving voltage ELVDD2 provided to a plurality of pixels including the second pixel PX2 in the second display area DA2. For example, the voltage providing unit 600 may increase the level of the second sub-driving voltage ELVDDL2. Accordingly, the amount of current supplied to the second organic light-emitting diode OLED2 included in the second pixel PX2 may be increased, thereby increasing the luminance of the second display area DA2.

Alternatively, in an embodiment, the voltage providing unit 600 may receive the third control signal CONT3 and adjust the level of the first sub-driving voltage ELVDD1 supplied to a plurality of pixels including the first pixel PX1 in the first display area DA1. For example, the voltage providing unit 600 may lower the level of the first sub-driving voltage ELVDDL1. Accordingly, the amount of current supplied to the first organic light-emitting diode OLED1 included in the first pixel PX1 may be reduced, thereby reducing the luminance of the first display area DA1.

Although not illustrated in the drawings, the voltage providing unit 600 may also provide a first driving voltage ELVDD to each of the first and second pixels PX1 and PX2, and provide third and fourth sub-driving voltages ELVSS1 and ELVSS2 which may have different levels.

Figure 15:
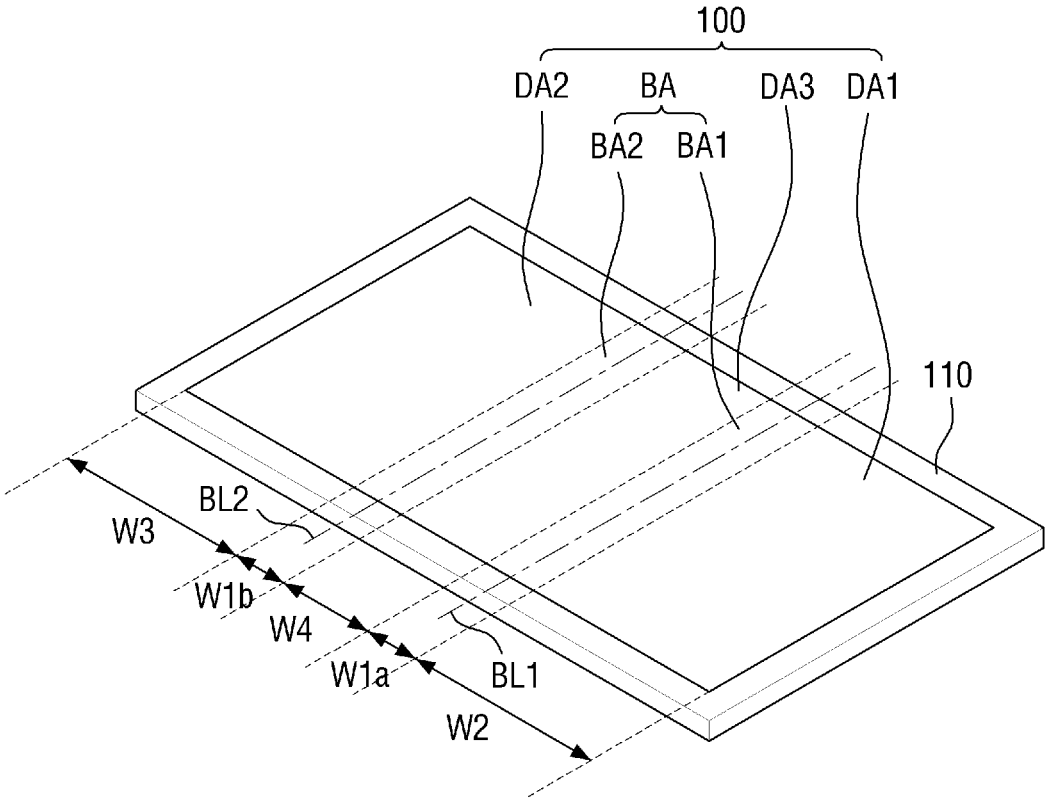
FIG. 15 is a perspective view of a flexible display apparatus according to an embodiment.
Figure 16:
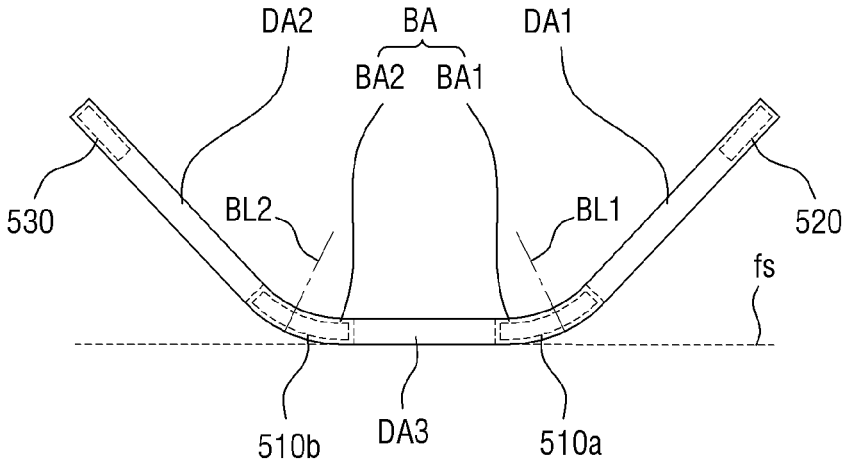
FIG. 16 is a s view of the flexible display apparatus illustrated in FIG. 15.

FIG. 15 is a perspective view of a flexible display apparatus according to an embodiment. FIG. 16 is a side view of the flexible display apparatus illustrated in FIG. 15. For simplicity, a description of elements and features identical to those described above with reference to FIGS. 1 through 14 will be omitted.

Referring to FIGS. 15 and 16, a display panel 100 may further include a third display area DA3 disposed between a first bending area BA1 and a second bending area BA2. In an embodiment, a width w4 of the third display area DA3 may be smaller than widths w2 and w3 of first and second display areas DA1 and DA2, respectively. However, the widths w2, w3, and w4 of the first, second, and third display areas DA1, DA2, and DA3, respectively, can also be equal.

The first bending area BA1 may be disposed on a side of the third display area DA3. The second bending area BA2 may be disposed on the other side opposite to the above side of the third display area DA3. The first bending area BA1 can be bent at a certain curvature with respect to a first bending line BL1. The second bending area B A2 can be bent at a certain curvature with respect to a second bending line BL2. In an embodiment, a width w1*a* of the first bending area BA1 may be equal to a width w1*b* of the second bending area BA2. That is, the first bending area BA1 may be symmetrical to the second bending area BA2 with respect to the third display area DA3. However, the width w1*a* of the first bending area BA1 can also be different from the width w1*b* of the second bending area BA2.

That is, the flexible display apparatus according to the current embodiment may include three display areas.

The flexible display apparatus according to the current embodiment may include a first sub-sensor unit 510*a* and a second sub-sensor unit 510*b*. The first sub-sensor unit 510*a* may determine whether the first bending area BA1 is bent. The second sub-sensor unit 510*b* may determine whether the second bending area BA2 is bent.

In an embodiment, the first sub-sensor unit 510*a* may be located in the first bending area BA1. In an embodiment, the second sub-sensor unit 510*b* may be located in the second bending area BA2. However, the position of the first sub-sensor unit 510*a* and the position of the second sub-sensor unit 510*b* are not limited to those illustrated in FIG. 16, and the position, size, number and shape of each of the first sub-sensor unit 510*a* and the second sub-sensor unit 510*b* are not particularly limited as long as the first sub-sensor unit 510*a* and the second sub-sensor unit 510*b* can determine whether the display panel 100 is bent.

While the cases where the number of display areas is two and three have been described above, the inventive concept is not limited to these cases.

According to embodiments, it is possible to improve image quality non-uniformity, luminance degradation, and color difference that may occur when a display panel is bent.

In addition, it is possible to improve a user's feeling of immersion and improve power efficiency by selecting a main viewing area and adjusting the display states of the main viewing area and an auxiliary viewing area.

Although some exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A flexible display apparatus comprising:

a display panel which comprises a first bending area bendable at a first angle along a bending line, a second bending area bendable at a second angle along the bending line, a first display area extending from the first bending area, and a second display area extending from the second bending area;

a first sensor unit which is configured to generate a first sensing signal by measuring the degree of deformation of at least one of the first and second bending areas;

a second sensor unit which is configured to generate a second sensing signal by measuring the first angle;

a third sensor unit which is configured to generate a third sensing signal by measuring the second angle; and a controller which is configured to receive the first, second, and third sensing signals, determine one of the first and second display areas to be a main viewing area based on the first, second, and third sensing signals, and adjust a display state of the main viewing area, wherein the first sensor unit is configured to measure a resistance change of at least one of the first and second bending areas and generate the first sensing signal based on the measured resistance change.

2. The flexible display apparatus of claim 1, wherein the controller is configured to correct at least one of luminance and color of the main viewing area based on at least one of the first, second, and third sensing signals.

3. The flexible display apparatus of claim 1, wherein the controller is configured to provide a start signal to at least one of the second and third sensor units when the measured resistance change exceeds a preset value.

4. The flexible display apparatus of claim 1, wherein a display area not determined to be the main viewing area among the first display area and the second display area is configured to display black.

5. The flexible display apparatus of claim 1, wherein each of the second and third sensor units comprises a gyro sensor.

6. The flexible display apparatus of claim 1, wherein the first sensor unit is located in at least one of the first bending area and the second bending area, the second sensor unit is located in the first display area, and the third sensor unit is located in the second display area.

7. A flexible display apparatus comprising:

a display panel which comprises a first bending area bendable at a first angle along a bending line, a second bending area bendable at a second angle along the bending line, a first display area extending from the first bending area, and a second display area extending from the second bending area;

a first sensor unit which is configured to generate a first sensing signal by measuring the degree of deformation of at least one of the first and second bending areas;

a second sensor unit which is configured to generate a second sensing signal by measuring the first angle;

a third sensor unit which is configured to generate a third sensing signal by measuring the second angle;

a controller which is configured to receive the first, second, and third sensing signals, determine one of the first and second display areas to be a main viewing area based on the first, second, and third sensing signals, and adjust a display state of the main viewing area; and a data driver which is configured to receive image data, generate a plurality of data signals based on the image data, and provide the generated data signals to the display panel, wherein the controller is configured to correct the image data based on at least one of the first, second, and third sensing signals.

8. A flexible display apparatus comprising:

a display panel which comprises a first bending area bendable at a first angle along a bending line, a second bending area bendable at a second angle along the bending line, a first display area extending from the first bending area, and a second display area extending from the second bending area;

a first sensor unit which is configured to generate a first sensing signal by measuring the degree of deformation of at least one of the first and second bending areas;

a second sensor unit which is configured to generate a second sensing signal by measuring the first angle;

a third sensor unit which is configured to generate a third sensing signal by measuring the second angle; and a controller which is configured to receive the first, second, and third sensing signals, determine one of the first and second display areas to be a main viewing area based on the first, second, and third sensing signals, and adjust a display state of the main viewing area, wherein the first display area comprises a first pixel which is configured to receive a first driving voltage, and the second display area comprises a second pixel which is configured to receive a second driving voltage, wherein the controller is configured to adjust a level of at least one of the first driving voltage and the second driving voltage based on at least one of the first, second, and third sensing signals.

9. A flexible display apparatus comprising:

a display panel which comprises a first bending area bendable at a first angle along a bending line, a second bending area bendable at a second angle along the bending line, a first display area extending from the first bending area, and a second display area extending from the second bending area;

a first sensor unit which is configured to generate a first sensing signal by measuring the degree of deformation of at least one of the first and second bending areas;

a second sensor unit which is configured to generate a second sensing signal by measuring the first angle;

a third sensor unit which is configured to generate a third sensing signal by measuring the second angle; and a controller which is configured to receive the first, second, and third sensing signals, determine one of the first and second display areas to be a main viewing area based on the first, second, and third sensing signals, and adjust a display state of the main viewing area, wherein the controller is configured to adjust the first and second display areas to have the same luminance when the first angle and the second angle are equal.

10. A flexible display apparatus comprising:

a display panel which comprises a first bending area bendable at a first angle along a bending line, a second bending area bendable at a second angle along the bending line, a first display area extending from the first bending area, and a second display area extending from the second bending area;

a first sensor unit which is configured to generate a first sensing signal by measuring the degree of deformation of at least one of the first and second bending areas;

a second sensor unit which is configured to generate a second sensing signal by measuring the first angle;

a third sensor unit which is configured to generate a third sensing signal by measuring the second angle; and a controller which is configured to receive the first, second, and third sensing signals, determine one of the first and second display areas to be a main viewing area based on the first, second, and third sensing signals, and adjust a display state of the main viewing area, wherein the controller is configured to reduce the luminance of a display area not determined to be the main viewing area among the first display area and the second display area.

11. A flexible display apparatus comprising:

a display panel which comprises a first bending area bendable at a first angle along a bending line, a second bending area bendable at a second angle along the bending line, a first display area extending from the first bending area, and a second display area extending from the second bending area;

a first sensor unit which is configured to generate a first sensing signal by measuring the degree of deformation of at least one of the first and second bending areas;

a second sensor unit which is configured to generate a second sensing signal by measuring the first angle;

a third sensor unit which is configured to generate a third sensing signal by measuring the second angle; and a controller which is configured to receive the first, second, and third sensing signals, determine one of the first and second display areas to be a main viewing area based on the first, second, and third sensing signals, and adjust a display state of the main viewing area, wherein the first sensor unit comprises a strain sensor and a hall sensor.

12. A method of driving a flexible display apparatus, the flexible display apparatus comprising:

a display panel which comprises a first bending area bendable at a first angle along a bending line, a second bending area bendable at a second angle along the bending line, a first display area extending from the first bending area, and a second display area extending from the second bending area;

a first sensor unit which is configured to generate a first sensing signal by measuring the degree of deformation of at least one of the first and second bending areas;

a second sensor unit which is configured to generate a second sensing signal by measuring the first angle;

a third sensor unit which is configured to generate a third sensing signal by measuring the second angle; and a controller which is configured to receive the first, second, and third sensing signals, determine one of the first and second display areas to be a main viewing area based on the first, second, and third sensing signals, and adjust a display state of the main viewing area, wherein the first sensor unit is configured to measure a resistance change of at least one of the first and second bending areas and generate the first sensing signal based on the measured resistance change, the method comprising:

determining whether the display panel comprising a plurality of display areas is bent;

measuring the degree of bending of the display panel upon a determination that the display panel is bent;

determining the main viewing area from among the display areas based on the measured degree of bending; and adjusting the display state of the main viewing area based on the measured degree of bending.

13. The method of claim 12, wherein the determining of the main viewing area comprises:

comparing the first angle and the second angle; and determining the main viewing area based on the comparing.

14. The method of claim 13, wherein the main viewing area is a display area connected to a bending area having a smaller one of the first angle and the second angle among the first and second bending areas.

15. The method of claim 12, wherein the adjusting of the display state of the main viewing area comprises correcting image data provided to the main viewing area.

16. The method of claim 12, wherein the adjusting of the display state of the main viewing area comprises adjusting a level of a driving voltage provided to the main viewing area.

17. The method of claim 12, wherein, in the adjusting of the display state of the main viewing area, at least one of luminance and color of the main viewing area is corrected based on the measured degree of bending.

* * * * *